United States Patent [19]

Givens et al.

[11] Patent Number: 4,521,299

[45] Date of Patent: Jun. 4, 1985

[54] REMOVAL OF BASIC NITROGEN COMPOUNDS FROM HYDROCARBON LIQUIDS

[75] Inventors: Edwin N. Givens, Bethlehem; David S. Hoover, New Tripoli, both of Pa.

[73] Assignee: International Coal Refining Company, Allentown, Pa.

[21] Appl. No.: 546,789

[22] Filed: Oct. 31, 1983

[51] Int. Cl.[3] ..... C10G 25/00

[52] U.S. Cl. ..... 208/254 R; 208/263; 208/307

[58] Field of Search ..... 208/91, 99, 112, 254 R, 208/307, 263; 210/903

[56] References Cited

U.S. PATENT DOCUMENTS

| | | | |
|---|---|---|---|
| 2,384,315 | 9/1945 | Kuhl | 208/91 |
| 3,112,258 | 11/1963 | Strecker | 208/254 R |
| 3,367,862 | 2/1968 | Mason et al. | 208/243 |
| 3,542,669 | 11/1970 | DeFeo | 208/91 |
| 4,410,421 | 10/1983 | Atherton et al. | 208/254 R |

*Primary Examiner*—D. E. Gantz
*Assistant Examiner*—O. Chaudhuri

[57] ABSTRACT

A method is provided for reducing the concentration of basic nitrogen compounds in hydrocarbonaceous feedstock fluids used in the refining industry by providing a solid particulate carbonaceous adsorbent/fuel material such as coal having active basic nitrogen complexing sites on the surface thereof and the coal with a hydrocarbonaceous feedstock containing basic nitrogen compounds to facilitate attraction of the basic nitrogen compounds to the complexing sites and the formation of complexes thereof on the surface of the coal. The adsorbent coal material and the complexes formed thereon are from the feedstock fluid to provide a hydrocarbonaceous fluid of reduced basic nitrogen compound concentration. The coal can then be used as fuel for boilers and the like.

6 Claims, No Drawings

REMOVAL OF BASIC NITROGEN COMPOUNDS FROM HYDROCARBON LIQUIDS

The Government of the United States of America has rights in this invention pursuant to Contract No. DE-AC05-780R03054 (as modified) awarded by the U.S. Department of Energy.

BACKGROUND AND SUMMARY OF THE INVENTION

The present invention relates generally to the beneficiation of feedstocks used in the refinery industry for preparing fuels and the like. More particularly, it is concerned with a new and improved process for reducing the nitrogen content of such fuel feedstocks by removal of basic nitrogen compounds from hydrocarbonaceous fluids obtained from various sources.

It is known in the industry that feedstocks used for preparing fluid fuels have contained varying amounts of hetero atom impurities and that such impurities have been a major problem for fuel refineries necessitating large capital outlays to handle the myrid of problems generated by the presence of such material. The major heteroatom impurities present in these fluid feed streams are sulfur, nitrogen and oxygen. Sulfur has created one of the more serious problems because of the resultant air pollution that occurs when sulfur-bearing hydrocarbon fuels are burned. Among the heteroatom impurities sulfur is the most easily removed and various means already have been developed and implemented for the control of that material. Oxygen typically is of little concern except for the small amount of phenolic compounds present in cracked gasolines. These impurities are removed primarily to improve the stability of the gasoline product, principally the discoloration of the fuel that occurs as result of their presence.

While nitrogen does not create as serious a pollution problem as sulfur, it is a very serious impurity from the viewpoint of a refiner since invariably it will act to deter, at least to some degree, almost every reaction that occurs as petroleum materials are refined. When nitrogen enters reformers, catalytic cracking units, hydrocrackers or polymerization units, the performace characteristics of these processes diminish significantly. The basic nitrogen compounds within the feedstocks tend to poison the catalysts used therein, particularly the acid and bifunctional catalyst systems. The impact of nitrogen concentrations down to levels of less than 100 parts per million will oftentimes kill cracking or hydrocracking activity, requiring the refiner to increase the severity of that operation in order to overcome the decrease in activity. Thus, substantial effort has been devoted to finding ways to inexpensively remove the nitrogen compounds from the feed streams before they enter the refining operations.

The techniques employed in the removal of such material from the feedstock have included, for example, chromatographic techniques wherein the basic nitrogen compounds are preferentially adsorbed onto solid supports such as silica, alumina or various grades of clay materials. In more recent years, as set forth in U.S. Pat. No. 4,090,951, syncrude feedstocks have been treated with materials selected from the group consisting of acid treated alumino-silicates, amorphous synethetic silica-alumina and crystalline silica-alumina cracking catalysts in order to provide a low nitrogen syncrude feedstock material. Other techniques have employed hydroprocessing procedures that use a hydrogen treatment at high hydrogen partial pressures over a catalyst such as metal sulfides. Extraction operations have also been reported in U.S. Pat. No. 4,071,435 using zine chloride followed by hydrocracking and in U.S. Pat. No. 4,159,940 using mineral acid extraction techniques.

Because adsorbing methods of the type described are inherently expensive, especially on fuel products which generally are not able to absorb much processing costs, hydroprocessing operations have been increasingly favored by refiners. Despite the high pressure vessels required in the hydroprocessing the technique is generally less expensive because there is no need to purchase clay and then discard it. Additionally, hydroprocessing operations tend to be continuous with only a minimum amount of down time. However such high pressure operations disadvantageously tend to be highly capital intensive, making them less competitive and correspondingly less desirable. Frequently, as in the first above-mentioned patent, the adsorbing technique is combined with a catalytic cracking operation in order to increase efficiencies of operation. Thereafter, the adsorbent is regenerated by removing from the spent adsorbent either thermally or by solvent extraction to recondition the adsorbent for reuse. As will be appreciated, the regeneration of the adsorbent is an additional cost factor that must be weighed against the cost of using a fresh supply of adsorber during the denitrogenation of the fuel feedstock.

In accordance with the present invention it has been found that the basic nitrogen compounds within fuel feedstock can be significantly reduced in a rapid, facile and economical manner by utilizing an adsorbing material which also is a fuel and can subsequently be utilized as a fuel after it has completed its adsorbing function. The utilization of such material obviates the problems associated with disposing of the adsorbent as an industrial product or the regeneration of the material for subsequent use. Not only does this eliminate the cost associated with such operations it also causes the cost of the adsorbent material to become insignificant since that material is itself used as a fuel. Such use of the adsorbent, of course, provides less incentive to recover that material for reuse as an adsorbent, particularly where the denitrogenation process takes place at locations where a large demand exists for the utilization of such a fuel and such demand is comparable to or exceeds its need as an adsorbent.

Advantageously, the removal of the basic nitrogen material from the feedstock by the process of the present invention avoids the procedures utilized hereforth and maximizes the value of this feedstock material for further processing. As can be appreciated, the utilization of the process of the present invention provides significant economic benefit since the material used as the adsorbing component can be readily, effectively and completely utilized after performing its adsorbing function by simply burning the material as a fuel in a conventional stationary boiler or other equivalent operation.

In addition to the economical factors associated with the process of the present invention, it will be noted that the efficiency of operation achieved by the technique employed herein can be superior to that achieved in accordance with the techniques reported in the above-referenced patents where the process provided a reduction of about 20 percent in the nitrogen concentration. The process utilized in accordance with the present invention provides nitrogen removal well above that 20 percent figure and, in fact, will show percent nitrogen removal up to about 85 percent and higher. Not only does the process of the present invention provide substantial high nitrogen removal but it performs this removal at low initial nitrogen concentrations, that is, at initial concentrations less than 1 percent, all without diminishing the removal efficiency. Thus, the nitrogen content of the treated feedstock is reduced to well below 1 percent and as low as 0.1 percent and less.

A further advantage of the present invention is that it also facilitates a reduction in the phenolic content of the feed stream concomitant with the denitrogenation thereby permitting an easier and more complete removal of the basic nitrogen compounds.

Other advantages will be in part obvious and in part pointed out more in detail hereinafter.

These and related advantages are achieved in accordance with the present invention by providing a new and improved method for reducing the concentration of basic nitrogen compounds in hydrocarbonaceous feedstock fluids. The method includes the steps of providing a solid particulate carbonaceous adsorbent/fuel material having active complexing sites on the surface thereof for complexing basic nitrogen compounds and contacting the solid adsorbent/fuel material with a hydrocarbonaceous feedstock fluid containing basic nitrogen compounds sufficiently to facilitate attraction of the basic nitrogen compounds to the complexing sites and the formation of complexes of those compounds on the surface of the solid adsorbent/fuel material. Subsequently, the solid particulate material and the complexes formed thereon are separated from the feedstock fluid to provide a hydrocarbonaceous fluid well suited for petroleum refining having a basic nitrogen compound concentration that is reduced by up to about 85 percent by weight and more.

A better understanding of this invention will be obtained from the following detailed description of the process including the several steps and the relation of one or more such steps with respect to each of the others and the products resulting therefrom possessing the features, characteristics, compositions, properties and relation of elements described and exemplified herein.

DESCRIPTION OF A PREFERRED EMBODIMENT

As mentioned hereinbefore, the present invention provides a technique for the beneficiation of feedstock for fuels through a reduction in the concentration of basic nitrogen compounds within that material so that the feedstock can be subsequently processed using various known fuel-refining techniques. This is accomplished by contacting the feedstock fluid, typically a liquid, with a solid, particulate carbonaceous material containing active complexing sites for complexing the basic nitrogen compounds within the feedstock and retaining the complex on the surface of the solid particulate material thereby removing the nitrogen compounds from the feedstock. The preferred solid particulate material, for economic reasons, also should be capable of use as a fuel, and in the preferred embodiment, involves the use of coal and other solid particulate coal-like or coal-derived materials.

The fluid feedstock being treated in accordance with the present invention is essentially a liquid feedstock material derived from any one of a number of sources. Thus, it may be a petroleum-based or petroleum-derived hydrocarbonaceous material or it could be a liquid obtained from tar sands or oil shale. Also included in the feedstock category are coal-derived liquids that have been at least partially refined yet are subject to further refining operations. These materials can include not only the heavy oils but also the distillate streams such as the distillate shale-oil stream. The coal-derived liquids may include either light distillates or heavier streams, such as fuel-oil materials obtained in coal liquidfication processes such as the solvent refined coal process. The preferred coal-derived oils have a boiling range of about 450° F.–850° F. and are soluable in carrier solvents such as pentane.

As will be appreciated, the hydrocarbonaceous liquid will include not only the predominant carbonaceous fluid material but also the basic nitrogen compound inpurities. Such impurities typically take the form of heterocyclic nitrogen compounds having about two to five carbon atoms within the ring structures. These include materials such as pyrroles, pyridines, indoles, quinolines and the like.

Where desired, the feed stream may be pretreated to reduce the phenolic content of the feed stream prior to contact with the adsorbent/fuel material. The reduction in the phenolic content is carried out in accordance with techniques well known in the art.

The solid particulate material employed in the invention beneficially operates, as mentioned, both as an adsorbent and as a fuel. Thus, solid carbonaceous materials are preferred. These may include solids such as coal that may be a run-of-mine material, a washed coal or one that has been pretreated in any of several ways, such as by acid washing to remove alkaline elements, e.g., calcium or sodium, and thereby improve the coals activity. Although the type of coal that could be used as an adsorber is not critical, the lighter, softer and more porous coals, such as subbituminous or bituminous coal or cokes are preferred in view of the higher concentration of complexing sites on the surfaces thereof. The higher ranking coals, such as anthracite coal may also be employed, particularly where it is treated to enhance its surface functionality, such as by partial oxidation of the solid coal material. Solvent refined coal or other derived solid carbonaceous materials also may be used.

The partial oxidation of the coal can be achieved in any of several ways known in the art. For example, simply passing air, oxygen or oxygen-enriched air or gas having an oxygen partial pressure of about 0.01–50 psi over the coal at temperatures ranging from subambiant temperatures up to as high as about 500° F. will be effective to activate the surface of the solid particulate material. This will provide carboxylic acid surface moieties that act as complexing functionalities at surface position such that when the basic nitrogen containing liquids are brought into contact with the coal the nitrogen compounds are complexed with the carboxylic functionalities on the particulate surfaces and are retained thereon leaving the liquid feed stream free of the nitrogen compounds or at least with reduced concentrations thereof.

Since the nitrogen-containing hydrogenaceous feed streams are typically in liquid form, the contact necessary for removal of the nitrogen compounds is of an intimate liquid-solid nature. A number of different contact techniques can be employed to achieve the necessary nitrogen compound removal. Thus, it is possible to provide intimate contact between the solid and liquid phases by using a simple reflux system. Alternately, flow streams may be employed using a trickle-bed configuration, a fixed downflow or upflow flooded bed or an ebullated-type bed configuration. Numerous other techniques also can be employed so long as they provide the necessary intimate contact between the liquid feed stream and the solid particulate adsorbent material.

The feed stream is brought into intimate surface contact with the solid particulate coal particles for a sufficient period of time and under appropriate conditions to provide for the complexing of the basic nitrogen compounds with the carboxylic acid functional sites on the surface of the coal particles. Thus, the undiluted feed stream can directly contact the particles or the oil can be carried in a solvent such as pentane in order to assure appropriate contact with the acidic surfaces of the particulate material. The complexing of the nitrogen compounds causing the retention of those materials on the particulate leaves the liquid stream free of these compounds so that it then can be hydroprocessed over a bifunctional catalyst to upgrade the stream to gasoline, light fuel oil and other more desirable fuels and chemical products or intermediates.

As will be appreciated, using the coal as an adsorbent will have little adverse effect on its value as a fuel material. The nitrogen compounds adsorbed onto the coal will constitute only a minute portion of the fuel and will not form a coating that might adversely affect its use in stationary boiler facilities and the like. Consequently, the cost of the adsorbent becomes negligible in such a system and, since the fuel material can reach its full useful potential, there is less incentive to attempt to rejuvenate or reuse the adsorbent material. At most locations the fuel demand will be quite large and will, in all likeihood, far exceed the demand for regenerating the adsorbent material.

Where the feed stream is used in conjuction with a carrier material or solvent, such carrier should be of a nature that will not have a deleterious effect on the subsequent utilization of the feed stream. Thus, if the feed stream is to be subsequently treated in the presence of a solvent, that particular solvent may be used as the carrier material during the denitrogenation process. Carriers that could be employed include paraffins, aromatics, oxygenated compounds or gaseous materials. For example, paraffins having 3 to 40 carbon atoms of either straight-chained or branch-chained configuration or mixtures thereof could be utilized. Such materials include light naphtha, kerosene and similar hydrocarbonaceous streams. Aromatic materials including fused ring systems with or without branch chains of various sizes can be employed as can alcohol, ethers and mixtures thereof or gaseous materials such as carbon dioxide, propane, isobutane or other materials that can be compressed to a phase such that they can have great solvency for the liquid thus offering advantages under certain circumstances. The coal particles may be slurried within the solvent prior to introducing the feed stream thereto and the contact between a feed stream and coal particulate material can take place under varying temperature and pressure conditions ranging from ambient conditions up to about 500° F. Of course the contact of the components will vary depending on the type of system employed but should be of sufficient time to facilitate the complexing of the basic nitrogen compounds on the surface of the coal particulate. Generally, the contact times will vary from as little as a few minutes up to a few hours.

Following the complexing action between the nitrogen compounds and the surface of the coal particles, the feed stream is separated from the solid particulate material. The respective materials may then be employed as indicated hereinbefore.

The following examples are given in order that the effectiveness of the present invention may be more fully understood. These examples are set forth for the purpose of illustration only and are not intended in any way to limit the practice of the invention. Unless otherwise specified, all parts are given by weight.

EXAMPLES 1-14

The identical coal-derived feed stream oil was used in all of these examples. A chemical analysis was made of the coal-derived oil before being treated. The analysis is set forth below:

| Element | Percent by Weight |
|---|---|
| Carbon | 87.88 |
| Hydrogen | 8.00 |
| Oxygen | 2.70 |
| Nitrogen | 0.81 |
| Sulfur | 0.62 |

The syncrude oil exhibited a boiling point range of 450° F.-850° F. Additionally, in each example the coal particles were slurried using 10 parts of coal to 40 parts of dispersing solvent and 1 part of coal-derived oil. All mixtures were stirred in a reflux system at 40° C. for about 4 hours. The fluids were then separated from the solid particulate material and the solvent was removed from the oil by evaporation.

Table 1 sets forth the results of 14 different experiments using the same coal-derived oil feedstock. The table shows the effect of the various particulate materials employed by indicating the percent of nitrogen removed for each material tested.

TABLE 1

| Example | Adsorbent | Nitrogen Removal (%) | Oxygen Removal (%) |
|---|---|---|---|
| 1 | Wyodak Subbituminous Rom | 84 | 37 |
| 2 | Ky #13 H. V. Bituminous Rom | 58 | 38 |
| 3 | Ky #9 H. V. Bituminous Clean Coal | 54 | 30 |
| 4 | Ky #9 H. V. Bituminous Clean Coal | 54 | 30 |
| 5 | Green Delayed SRC Coke | 48 | 30 |
| 6 | Ky #11 H. V. Bituminous Clean Coal | 44 | 24 |
| 7 | Ky #14 H. V. Bituminous Clean Coal | 42 | 25 |
| 8 | Ky #9 H. V. Bituminous Clean Coal | 42 | 22 |
| 9 | Ky #9 H. V. Bituminous Clean Coal | 41 | 29 |
| 10 | Ky #6 H. V. Bituminous Clean Coal | 37 | 26 |
| 11 | Ky #9 H. V. Bituminous Clean Coal | 33 | 24 |
| 12 | Ky #9 H. V. Bituminous Clean Coal | 30 | 22 |
| 13 | Ky #9 H. V. Bituminous Clean Coal | 27 | 13 |
| 14 | Lykens Valley Anthracite Rom | 17 | 16 |

As will be noted, the percent nitrogen removal ranged from 17 percent to 84 percent with the subbituminous coal, which is a low ranking subbituminous material having a substantial concentration of carboxylic acid groups, exhibited the best results while the higher grade anthracite coal provided the lowest nitrogen removal. The oxygen removal data evidences the effectiveness of the method in the removal of phenolic compounds from the feedstock.

As will be apparent to persons skilled in the art, various modifications and adaptations of the structure above described will become readily apparent without departure from the spirit and scope of the invention, the scope of which is defined in the appended claims.

What is claimed is:

1. A method for reducing the concentration of basic nitrogen compounds in hydrocarbonaceous feedstock fluids comprising the steps of:

(a) providing anthracite coal having active basic nitrogen complexing sites on the surface thereof, (b) contacting said anthracite coal with air, oxygen or oxygen-enriched air having an oxygen partial pressure of about 0.01 to 50 psi at a temperature of from sub-ambient to 500° F. to activate and form on the surface of said anthracite coal carboxylic acid moiety complexing sites, (c) contacting said anthracite coal having said activated surface with said hydrocarbonaceous feedstock fluid containing said basic nitrogen compounds at a temperature ranging from ambient up to 500° F. to facilitate attraction of the basic nitrogen compounds to said carboxylic acid moiety complexing sites and formation and adsorption of said nitrogen compounds at said carboxylic acid moiety complexing sites on the surface of said anthracite coal, and (d) subsequently separating said anthracite coal and the complexes formed thereon from the feedstock fluid to provide a hydrocarbonaceous fluid of reduced basic nitrogen compound concentration.

2. The method of claim 1 wherein the step of contacting the anthracite coal with the fluid takes place in the presence of a carrier material.

3. The method of claim 2 wherein the anthracite coal is slurried in the carrier material during contact with the feedstock fluid.

4. The method of claim 2 wherein the carrier material is a solvent for the feedstock fluid.

5. The method of claim 1 wherein the contact of said anthracite coal and fluid is carried out for a period of time sufficient to permit complexing of the basic nitrogen compounds within the fluid at the complexing sites on the anthracite coal.

6. The method of claim 1 wherein said contact of said anthracite coal with the feedstock fluid is effective to reduce the concentration of phenolic compounds in said fluid.

* * * * *